US005425507A

United States Patent [19]

Stumpff

[11] Patent Number: 5,425,507

[45] Date of Patent: Jun. 20, 1995

[54] METHOD AND APPARATUS FOR COMMINUTING MATERIALS

[76] Inventor: Roger Stumpff, Rt. 4, Sterling, Colo. 80751

[21] Appl. No.: 25,955

[22] Filed: Mar. 3, 1993

[51] Int. Cl.[6] ..... B02C 13/10; B02C 19/22

[52] U.S. Cl. ..... 241/152.2; 241/29; 241/260.1; 241/DIG. 38

[58] Field of Search ..... 241/186.5, 29, 27, 152.2, 241/260.1, DIG. 38, 247

[56] References Cited

U.S. PATENT DOCUMENTS

| | | | |
|---|---|---|---|
| 1,464,621 | 8/1923 | Kemp . | |
| 1,524,887 | 2/1925 | Ronning . | |
| 1,697,925 | 1/1929 | McKay . | |
| 1,862,396 | 6/1932 | Gray . | |
| 1,987,656 | 1/1935 | Althouse . | |
| 2,239,486 | 4/1941 | Edwards . | |
| 2,280,677 | 4/1942 | Wagner . | |
| 2,416,043 | 2/1947 | Bucher-Guyer . | |
| 2,493,918 | 1/1950 | Hill . | |
| 2,496,493 | 2/1950 | Raney . | |
| 2,701,595 | 2/1955 | Berger . | |
| 3,498,548 | 3/1970 | Gruendler et al. | 241/186.5 |
| 3,658,262 | 4/1972 | Burant, Jr. . | |
| 3,756,517 | 9/1973 | Hoch . | |
| 3,826,436 | 7/1974 | Cetrulo . | |
| 3,856,218 | 12/1974 | Harmon . | |
| 4,003,502 | 1/1977 | Barcell . | |
| 4,027,824 | 6/1977 | Fuller | 241/152.2 |
| 4,043,515 | 8/1977 | Brundler . | |
| 4,106,706 | 8/1978 | Burrows . | |
| 4,448,361 | 5/1984 | Marcy . | |
| 4,485,976 | 12/1984 | White . | |
| 4,600,160 | 7/1986 | Mengel . | |
| 4,790,489 | 12/1988 | Paul . | |
| 4,852,817 | 8/1989 | Tiptom | 241/260.1 |
| 4,892,259 | 1/1990 | von der Heide . | |
| 4,923,128 | 5/1990 | Ostrowski . | |
| 4,934,615 | 6/1990 | Osborne . | |
| 5,082,188 | 1/1992 | Urich . | |
| 5,240,188 | 8/1993 | Whitmire | 241/152.2 |

FOREIGN PATENT DOCUMENTS

| | | | |
|---|---|---|---|
| 1641223 | 4/1991 | U.S.S.R. | 241/186.5 |

*Primary Examiner*—Douglas D. Watts
*Attorney, Agent, or Firm*—Duane Burton

[57] ABSTRACT

A method and apparatus for reducing material, such as trash, refuse, garbage and the like, to a specified size of particles. The apparatus is directed to a single comminuting chamber means as well as to a combination of first and second comminuting chamber means. The first comminuting chamber means includes in the lower portion of said chamber means a flow passage means of varying volume through which the particles pass thereby preventing wedging or packing of the particles in the first comminuting chamber means during the comminution of the material therein. The second comminuting chamber means includes a screenless hammer mill means having holding bars or means for holding pieces of material that exceed a predetermined length until said pieces are reduced to a length equal to or less than said predetermined length. The first comminuting chamber means may also include at least one or more fine grinding means for further reducing the size of pieces of material by increasing the time for material to pass through the first comminuting chamber means. The first comminuting means preferably includes a drum and the second comminuting chamber means includes hammer support structure, said drum and said hammer support structure being rotatably mounted in the respective chambers. Comminuting means may be attached to the rotating members mounted in each chamber means. Rotation of the drum in the first comminuting chamber means creates a positive air pressure which assists in moving the particles through the first chamber means and into the second chamber means. This positive air pressure may be augmented by connecting the discharge side of the second chamber means in fluid communication with a source of reduced pressure.

20 Claims, 7 Drawing Sheets

Fig_5
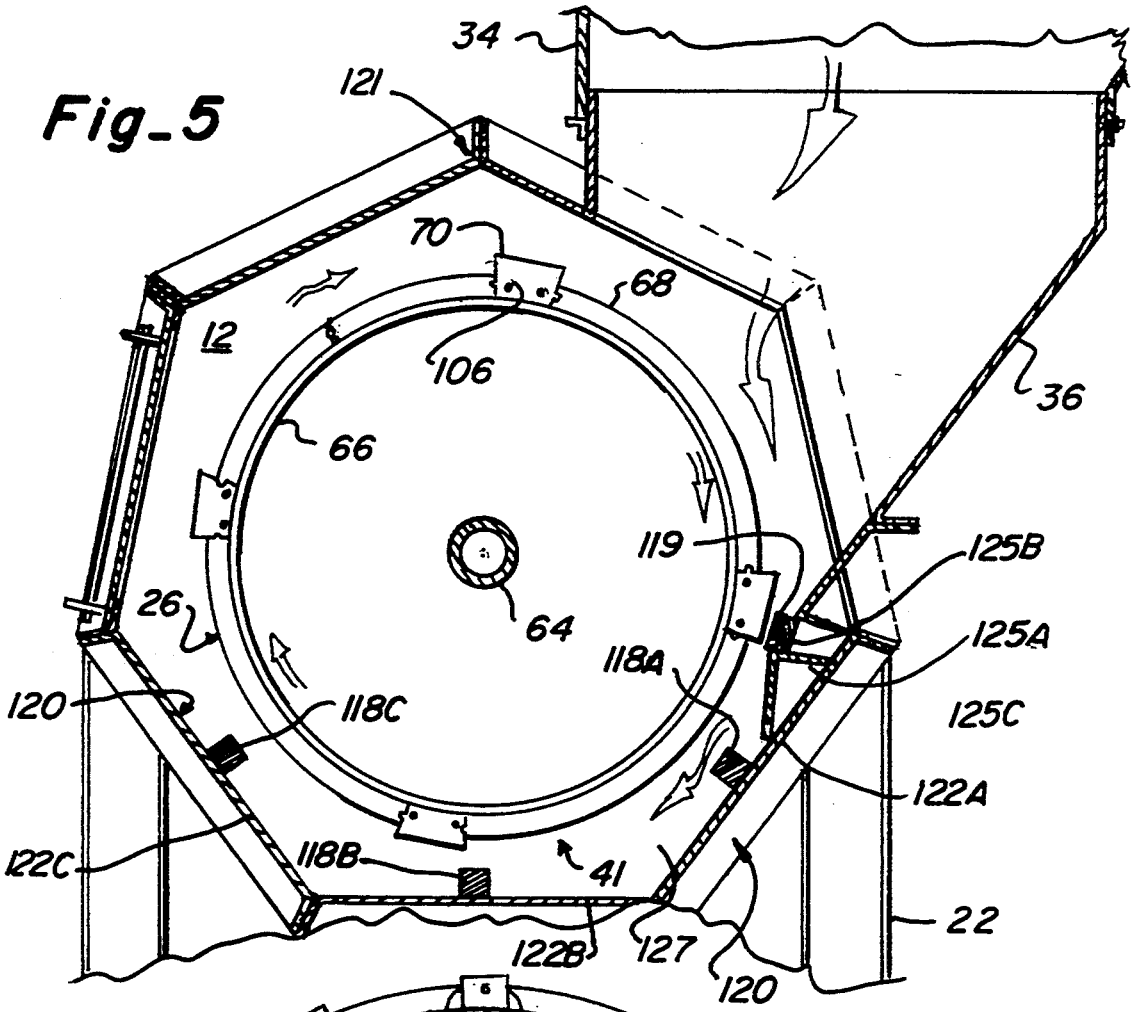
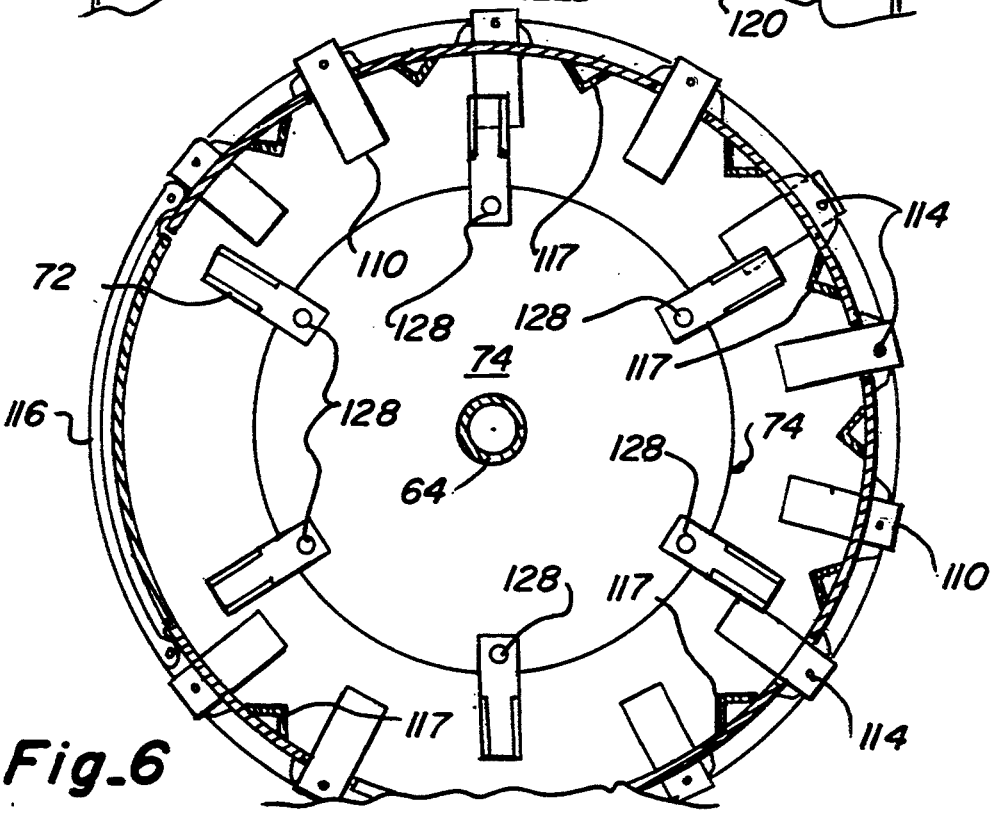
Fig_6

METHOD AND APPARATUS FOR COMMINUTING MATERIALS

FIELD OF THE INVENTION

This invention relates to a method and apparatus for comminuting or reducing the size of materials. In particular, this invention relates to a method and apparatus for comminuting heterogeneous sized materials and reducing pieces of material to a size not greater than a predetermined size. It is especially useful in comminuting refuse, trash, pallet material and garbage.

BACKGROUND

Comminuting constitutes reducing materials to smaller sizes. This can be accomplished with pulverizing, cutting, or other means.

Garbage, trash, and refuse pose special problems for conventional comminution methods. The material to be comminuted has a wide range of size, length and composition such as hardness. The same load of garbage or refuse may contain lumber, rocks, earth, glass, metal and plastic along with softer materials such as paper, cloth and cardboard.

This traditionally has not been a problem since large pieces of refuse or garbage could be disposed of in sanitary landfills. However, in some areas and in the near future, this option is or may rapidly disappear. Landfill space in some areas, if available at all, is at a premium. Additionally, the Environmental Protection Agency has mandated additional requirements, limiting this method of disposing of garbage or refuse.

In many areas, refuse and garbage are being burned or converted to less hazardous states. This burning or other conversion invariably requires a more uniform size of particle than is required of garbage or refuse to be stored at a landfill. Such conversion requires small, even sized particles because they are easier to handle and they burn much more rapidly than do larger pieces of material.

The existing technology has proven inadequate for efficiently reducing such a wide range of materials to small particles, regardless of the consistency of the materials being comminuted.

A large number of patents discuss comminution of one material or another. For practical reasons, the discussion of patents and other art immediately following is limited to those methods and apparatuses believed to be the most relevant.

U.S. Pat. No. 5,082,188 to Urich discloses a vertically mounted two chamber comminuting machine, with fliting attached to a cone in the first chamber to form a screw. The first (feed) chamber is conically shaped, as contrasted with a generally cylindrically shaped chamber (or multi-sided polygon shaped chamber) found in the instant invention. This conical shape works well when comminuting hay bales (the subject of the Urich patent), but was never designed to comminute refuse or garbage. For example, pieces of lumber fed into the machine would often be flung out of the machine, endangering both operators and nearby equipment. A vertical orientation is not as effective as the horizontal orientation used in comminuting the range of materials found in refuse and garbage. Finally, the Urich patent invention does not disclose the use of holding bars for holding long pieces of material.

U.S. Pat. No. 2,701,595 to Berger discloses a two stage comminution machine, with horizontally mounted rotating cylinders located in each comminuting chamber. The invention is attached to the front of a harvesting machine such as a combine. At a minimum, the Berger patent does not disclose the use of longitudinally extending, generally planar sides in the lower portion of the first comminuting chamber or a seven-sided polygon shape for the first comminution chamber, the use of holding bars, or the use of removable blades.

Additionally, the inventor of this invention is aware of at least one instance of a vertically oriented screw mounted in a multi-sided polygon. However, in that apparatus, the screw was limited in its use to simply move material. In any event, that apparatus was not used nor 10 did it perform comminution.

Prior art apparatuses were disadvantageous because the comminuted material would frequently wedge or pack between a rotating drum (which carried the reducing means) and the housing for the drum. Other apparatuses were ineffective in comminuting longer pieces of material contained in the material being reduced.

BRIEF SUMMARY OF THE INVENTION

The present invention is either a one stage or two stage comminuting method and apparatus. Where two stages are involved, the first stage performs a (relatively) course comminution, converting relatively large sized pieces of material into intermediate sized particles. The second stage performs a finer comminution, converting the intermediate sized particles from the first stage into smaller, final sized particles. The second stage preferably includes a screenless hammer mill means, i.e., a hammer mill sans the screen through which the hammers drive the pieces of material. The two comminuting chamber means correspond to the two stages.

The first stage contains a rotatably mounted, horizontally disposed cylinder or drum. Preferably the material to be comminuted is prescreened. Following prescreening, the material to be reduced in size is fed into the first chamber means, preferably through an opening formed in the top of the first chamber means. The cylinder or drum in the first chamber means has spiral fliting attached thereto to form an Archimedes-type screw. The rotating screw conveys the particles from the first stage or chamber means to the inlet means of the second chamber means. Rotation of the screw also creates a positive air pressure which aids in moving the particles through the first chamber means into the second chamber means. Attached to the fliting in a staggered pattern are blades used in performing the first stage comminution. The blades are preferably removably attached to the fliting such as with nuts and bolts, allowing for easy removal and replacement when they become worn. The number of blades used can be varied as the consistency of the input refuse or garbage is varied. Additionally, this easy removal and replacement is advantageous as blades wear out quickly when used to comminute refuse containing glass, lumber, rocks, and the like. Depending on the alloy in the metal used and the treatment to which they are subjected, the blade may require replacement within days, or, at least, within a few weeks. Cutting edges are formed on opposite edges of the blades. When one edge is worn, the blade may be reversed thereby doubling the life of the blade.

The second comminuting chamber means contains one or more holding bars. These holding bars are mounted longitudinally extending on the interior walls of the housing of the chamber means, disposed generally parallel to the axis of rotation of the screw mounted in the first chamber means. The holding bars function to hold pieces of material longer than a predetermined size, giving the blades or hammers an opportunity to reduce the longer pieces to a size equal to or less than the predetermined size.

The first chamber means may also contain one or more fine grinding, holding means to increase the time required for the material to pass through the first chamber means and thereby produce smaller pieces of particles. Together, the blades and the holding bars deliver a modified scissoring or shearing action to reduce the size of the longer pieces of material.

The first chamber is formed by a plurality of longitudinally extending planar sides, with the screw or drum being mounted to rotate thereabove. Three such sides form the lower portion of said chamber means. This construction forms, upon rotation of the screw or drum, a flow passage means of variable volume between the screw and the lower part of the housing, i.e., proceeding in the direction of rotation, the volume decreases from a maximum volume adjacent the intersection of the two adjacent sides to a predetermined minimum volume and then increases to a predetermined maximum volume adjacent the next intersection of two sides. The variance in volume exceeds about 33% and may vary from 250% up to 1800%. This variable volume feature substantially alleviates the packing and wedging of materials, particularly nonhomogeneous materials, in the chamber means by allowing some pieces to "kick" backward (into the area of larger volume) thereby preventing an undesirable "wedge" of material from forming. This is especially helpful when the material being comminuted has a wide range of sizes, as is found in garbage, refuse and the like. Such a chamber means with too many planar sides would approximate a more nearly cylindrical shape, allowing more wedging and packing.

Comminuted sized particles are transported by the screw into the inlet means of the second chamber means formed in one side thereof. Exiting the other side (discharge side means) of the second chamber means, the particles have been reduced to a smaller, final size. Hammers are attached to rapidly rotating hammer supports mounted in the second chamber means. These hammers act to pulverize the particles produced in the first stage comminution. In the second chamber means, blades directed radially inward are attached to the housing. These blades and the hammers cooperate as scissors or shears to further reduce the size of particles. The blades extend into the second chamber means, but are attached to the outside of the second stage chamber means, allowing for easy removal and replacement. This allows the number of blades to be easily modified as the material being comminuted changes, as well as varying the specified final particle size. This also allows for easy replacement of the blades when the comminuted refuse contains glass, lumber, rocks, concrete and the like. Finally, there are holding bars mounted on the inside of the housing. The use of holding bars longitudinally extending along the inner housing of the second chamber means greatly assists in reducing longer pieces of material contained in the material being comminuted.

This invention does an effective job in comminuting materials that contain a wide range of sizes and types of materials, such as found in garbage, trash and refuse. Long pieces of wood are easily converted into wood chips. Glass, earth and even small rocks can be safely processed.

One of the objects of this invention is to provide a method of reducing material to an approximate specified final size of particles comprising feeding the material to be reduced in to a first chamber means, comminuting said material in said first chamber means to an approximate specified intermediate size of particles while providing in the lower portion of the first chamber means a flow passage means of varying volume through which the particles pass thereby preventing wedging of said particles in the first chamber means during the comminution of materials therein, feeding said intermediate size of particles into a second chamber means and comminuting said intermediate size particles in said second chamber means to an approximate final size of particles.

Another object of this invention is to provide a method in which the step of feeding said intermediate size particles into a second chamber means includes feeding said intermediate size of particles into said second chamber having a screenless hammer mill means.

Another object of this invention is to provide a method including the step of holding in said screenless hammer mill means pieces of material that exceed a predetermined length until said pieces of material are reduced to a length equal to or less than said predetermined length.

Another object of this invention is to provide a method including the step of assisting the flow of comminuted particles through the first and second comminuting chamber means by providing said second chamber means with a discharge means and connecting said discharge means to a source of pressure less than that existing in the second chamber means during comminution of pieces of material therein.

Another object of this invention is to provide a method including the step of holding in said first chamber means pieces of material including those that exceed a predetermined length until said pieces including those that exceed a predetermined length are reduced to a length equal to or less than said predetermined length and then comminuting the pieces of reduced length until they are approximately equal to or less than the size of said approximate intermediate size of particles.

Another object of this invention is to provide a method including the step of prescreening the material to be reduced in size and removing from same material that exceeds a predetermined size, length or composition.

Another object of this invention is to provide a method including the step of removing said final size particles from said second chamber means.

Another object of this invention is to provide a method in which the volume of the flow passage means varies at least approximately 250%.

Another object of this invention is to provide a method of reducing material to an approximate specified final size of particles comprising feeding the materials to be reduced into a first chamber means, comminuting said material in said first chamber means to an approximate specified intermediate size particles, feeding said intermediate size particles into a second chamber means having a screenless hammer mill means and comminuting said material in said screenless hammer mill means to an approximate specified final size of particles while holding pieces of said material longer than a predetermined length until same are reduced to a length equal to or less than said predetermined length and then comminuting same until they are approximately equal to or less than the length of said approximate final size of particles.

Another object of this invention is to provide a method including the step of assisting the flow of comminuted particles through the first and second comminuting chamber means by providing said second chamber means with a discharge means and connecting said discharge means to a source of pressure less than that existing in the second chamber means during comminution of pieces of material therein.

Another object of this invention is to provide a method including the step of prescreening the material to be reduced in size by removing from said material pieces of material that exceed a predetermined size, length or composition.

Another object of this invention is to provide a method including the step of removing said approximate final sized particles from said second chamber means.

Another object of this invention is to provide an apparatus for reducing material to an approximate specified final size of particles comprising first and second comminuting chamber means, each of said first and second comminuting chamber means having inlet and discharge means, means for providing in the lower portion of said first chamber means a flow passage means of varying volume through which passes the material to be reduced in size, said first comminuting means including means for comminuting said material to an approximate specified intermediate size of particles, said comminuting means including means for feeding said approximate specified intermediate size of particles into said the second comminuting chamber means and said second comminuting chamber including means for comminuting said specified approximate intermediate size of particles.

Another object of this invention is to provide an apparatus in which said second comminuting chamber means includes a screenless hammer mill means for comminuting said approximate specified intermediate size particles to said approximate specified final size of particles.

Another object of this invention is to provide an apparatus including means for holding in said screenless hammer mill means pieces of material that exceed a predetermined length until said pieces are reduced to a length equal to or less than said predetermined length.

Another object of this invention is to provide an apparatus in which said comminuting means in said first chamber means includes means for assisting the flow of comminuted particles through said second comminuting chamber means during comminution of the pieces of material in said second comminuting chamber means.

Another object of this invention is to provide an apparatus including means for connecting the discharge means of said second chamber means in fluid communication with a pressure less than the pressure inside said second chamber means during comminution of the pieces of material in said second comminuting chamber means.

Another object of this invention is to provide an apparatus including means for prescreening the material to be comminuted and removing from said material pieces of material that exceed a predetermined size, length or composition.

Another object of this invention is to provide an apparatus including means for moving said final sized particles away from said second chamber means.

Another object of this invention is to provide an apparatus wherein said means for moving said final size of particles away from said second comminuting means includes a screw means located to receive material from the discharge means of said second chamber means.

Another object of this invention is to provide an apparatus wherein said means for moving said final size of particles away from said second comminuting means includes a conveyer belt located to receive material from the discharge means of said second comminuting chamber means.

Another object of this invention is to provide an apparatus wherein said means for moving said final size of particles away from said second chamber means includes a fan means having a suction side disposed in fluid communication with said second comminuting chamber means.

Another object of this invention is to provide an apparatus including means for holding in the lower portion of said first comminuting chamber means long pieces of material until same are reduced to a length equal to or less than said predetermined length.

Another object of this invention is to provide an apparatus wherein said first comminuting chamber means includes a housing and a rotatably mounted, cylindrically shaped drum disposed substantially horizontal in said housing, said cylindrically shaped drum including a fliting spirally mounted thereon to form a screw which, during rotation of said drum, moves the material through said first chamber means toward the discharge means of said first comminuting chamber means and into the inlet means of said second comminuting chamber means, said first comminuting chamber means includes means for reducing the size of said material to an intermediate size of particles and at least a portion of said reducing means of said first chamber means being removably mounted within said first chamber means.

Another object of this invention is to provide an apparatus in which said fliting is mounted on said drum disposed in said first comminuting chamber means.

Another object of this invention is to provide an apparatus in which said fliting is removably mounted on said drum.

Another object of this invention is to provide an apparatus in which said portion of said reducing means is removably mounted relative to said fliting.

Another object of this invention is to provide an apparatus in which said portion of said reducing means is removably mounted on said housing of said first comminuting chamber means.

Another object of this invention is to provide an apparatus wherein said first comminuting chamber means includes a housing formed from seven longitudinally extending, generally planar sides which form the inner periphery of said first comminuting chamber means.

Another object of this invention is to provide an apparatus wherein said comminuting second chamber means includes a housing and said holding means is mounted on and extends longitudinally along the inner surface of said housing adjacent the inlet to the lower portion of said housing.

Another object of this invention is to provide an apparatus wherein at least a portion of said reducing means is, in elevational view, a four sided polygon having cutting edges formed on opposite sides thereof, said cutting edges extending generally radially within said first comminuting chamber means.

Another object of this invention is to provide an apparatus in which said screenless hammer mill means includes a plurality of hammers and a support means for said hammers, said support means being rotatably mounted within said second comminuting chamber means.

Another object of this invention is to provide an apparatus wherein the first comminuting chamber means includes a generally cylindrically shaped drum rotatably mounted therein and said drum and said support for said hammer means are mounted substantially horizontal in their respective chamber means, the axis of rotation of said drum being generally collinear with the axis of rotation of said support for said hammer means.

Another object of this invention is to provide an apparatus for reducing material to an approximate specified size of particles comprising a screenless hammer mill means, said screenless hammer mill means including a housing and means for comminuting said material in said screenless hammer mill means to an approximate specified size of particles including means for holding pieces of materials longer than a predetermined length until reduced to a length equal to or less than said predetermined length, said holding means extending generally longitudinally along the interior of said housing.

Another object of this invention is to provide and apparatus for reducing material to an approximate specified size of particles comprising a comminuting chamber means having a housing and including means for comminuting said pieces of material and means formed on the lower portion of said housing of said chamber means for providing a flow passage means of varying volume through which passes the material during the comminution of said material, said flow passage means of varying volume preventing wedging of said material during flow of material therethrough.

Another object of this invention is to provide an apparatus in which the lower portion of the inner surface of said housing is formed by three longitudinally extending planar portions, the angle formed between the middle on of said planar portions and the adjacent planar portions varying from 120° to 140°.

Another object of this invention is to provide an apparatus including at least one fine grind holding means located in the lower portion of said housing and extending generally longitudinally along the interior of said housing.

Another object of this invention is to provide an apparatus in which the angle formed between the middle one of said planar portions and the adjacent planar portions is equal to approximately 130°.

Additional objects and advantages of this invention will become apparent from the description which follows, taken in conjunction with the accompanying drawings.

BRIEF DESCRIPTION OF THE DRAWINGS

FIG. 5 is a vertical cross-sectional view of the first comminuting chamber means taken generally along plane 5—5 of FIG. 4, including a portion omitted from FIG. 4, with the cutting plane perpendicular to the drive shaft;

FIG. 6 is a vertical cross-sectional view of the second comminuting chamber means taken generally along line 6—6 of FIG. 4, with the cutting plane perpendicular to the drive shaft;

DETAILED DESCRIPTION OF THE PREFERRED EMBODIMENT

Figure 1:
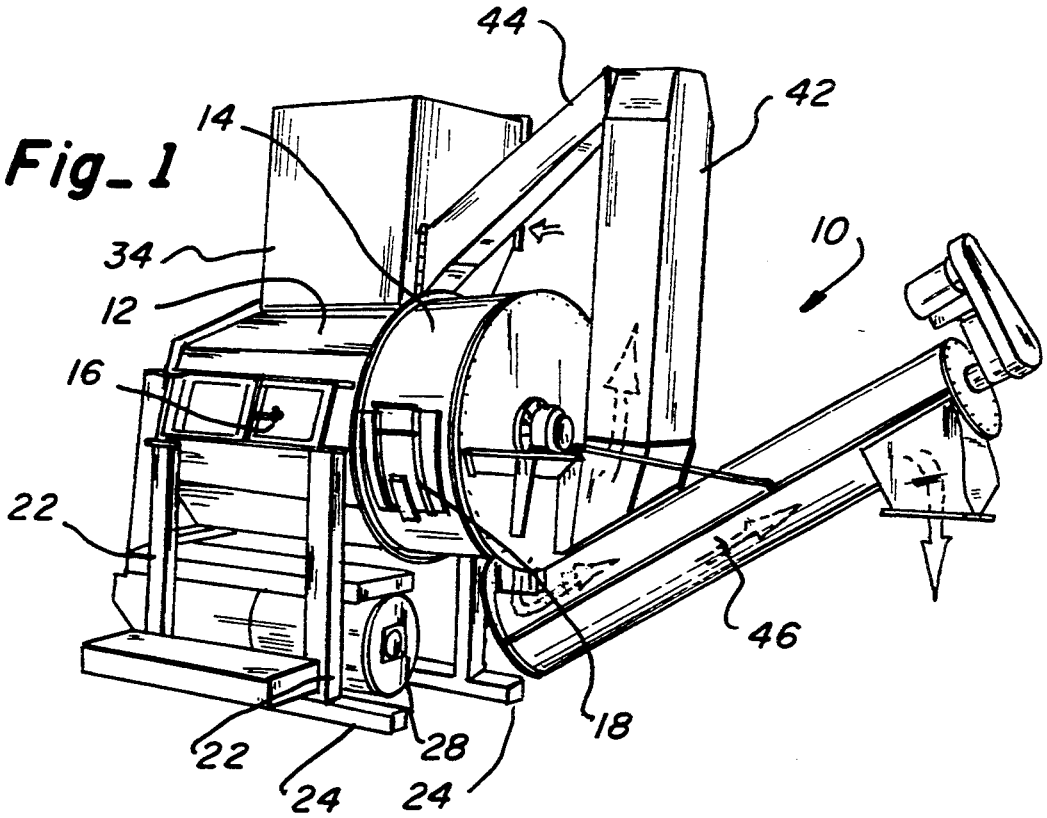
FIG. 1 is a front perspective view of the embodiment of the invention in which access ports for the two comminuting chamber means are shown.

FIG. 1 shows a front perspective view of an apparatus 10 for comminuting materials in accordance with the method this invention. Apparatus 10 has two comminuting chamber means, a first (coarse) comminuting chamber means 12 and a second (fine) comminuting chamber means 14 (see also FIGS. 3A–3C). Both the first comminuting chamber means 12 and the second comminuting chamber means 14 have, respectively, access ports 16, 18. These access ports 16, 18 are used to carry out inspection and maintenance of the components contained in the first and second chamber means 12, 14.

The two chamber means 12, 14 are supported by vertical supports 22. The vertical supports 22 rest on lower horizontal supports 24. The screw 26 in the first comminuting chamber means 12 is driven by a motor 28 (see FIG. 3). In one embodiment of the apparatus 10, a 200 horsepower electric motor 28 is used. Depending on the material to be comminuted, a larger (300 horse power or more) may be used. Additionally, a diesel motor (not shown) is foreseen for situations where electricity is not practical. One possible application of such a diesel motor would be to mount the apparatus 10 and its motor 28 on a trailer (not shown). This would allow the apparatus 10 to be moved quickly and easily from one site to another.

Figure 2:
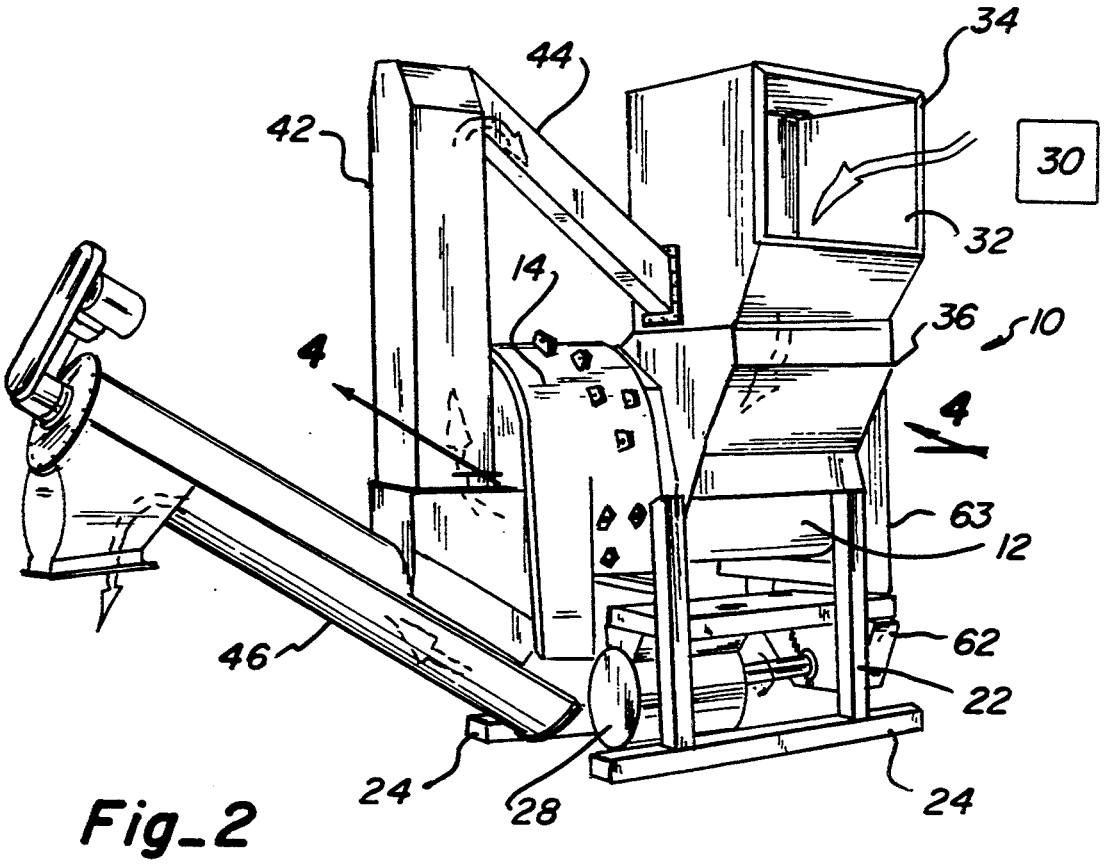
FIG. 2 is a rear perspective view of the embodiment shown in FIG. 1.

Refuse, garbage, trash, or other material to be reduced in size is preferably first prescreened at area 30 before it is fed into the apparatus 10, see FIG. 2. This prescreening eliminates anything that cannot fit through the feed hood opening 32 (see FIG. 2) and anything (such as concrete, metal pieces and the like) that obviously cannot be effectively comminuted by apparatus 10 or would cause damage thereto. The prescreened material is then fed through the feed hood 34. As shown in FIG. 2, this hood 34 sits above a feed chamber means 36. The feed chamber means 36 in turn sits on top of the first (coarse) comminuting chamber means 12. After being fed into the feed hood 34, the material to be reduced in size drops through the feed chamber means 36, into top of the first comminuting chamber means 12.

The material to be reduced in size is comminuted first in the first comminuting chamber means 12 where it is comminuted to an intermediate size of particle. During and following such comminution, it is conveyed (see FIG. 3) by screw 26 into the second (fine) comminuting chamber means 14 where it is ground to a size equal to or less than a final specified size. Following comminution in the second chamber means 14, any one of a number of methods or means of clearing the second chamber means 14 may be used. It will be understood that in the embodiment disclosed in FIG. 1, the rotational speed of the screw 26 creates sufficient positive air pressure to clear or pass through the first chamber means 12 approximately 3500 cu. ft./min. with a 100 horsepower motor. If this is not sufficient, to carry the particles through the first chamber means 12, a fan 38 (shown schematically in dotted lines in FIG. 3) can be suitably mounted on the driven shaft 64 located downstream of the second chamber means 14 to provide negative air pressure to help clear the second chamber means 14 of the comminuted material.

The output air, shown by the arrow 40 (see FIG. 3) is cleaned up by directing it back through the return ducts or chutes 42, 44 (see FIGS. 1 and 2), feed hood 34 and feed chamber means 36 to the first comminuting chamber means 12. This reduces the effect that the positive air pressure might have on the freshly comminuted material.

Figure 3:
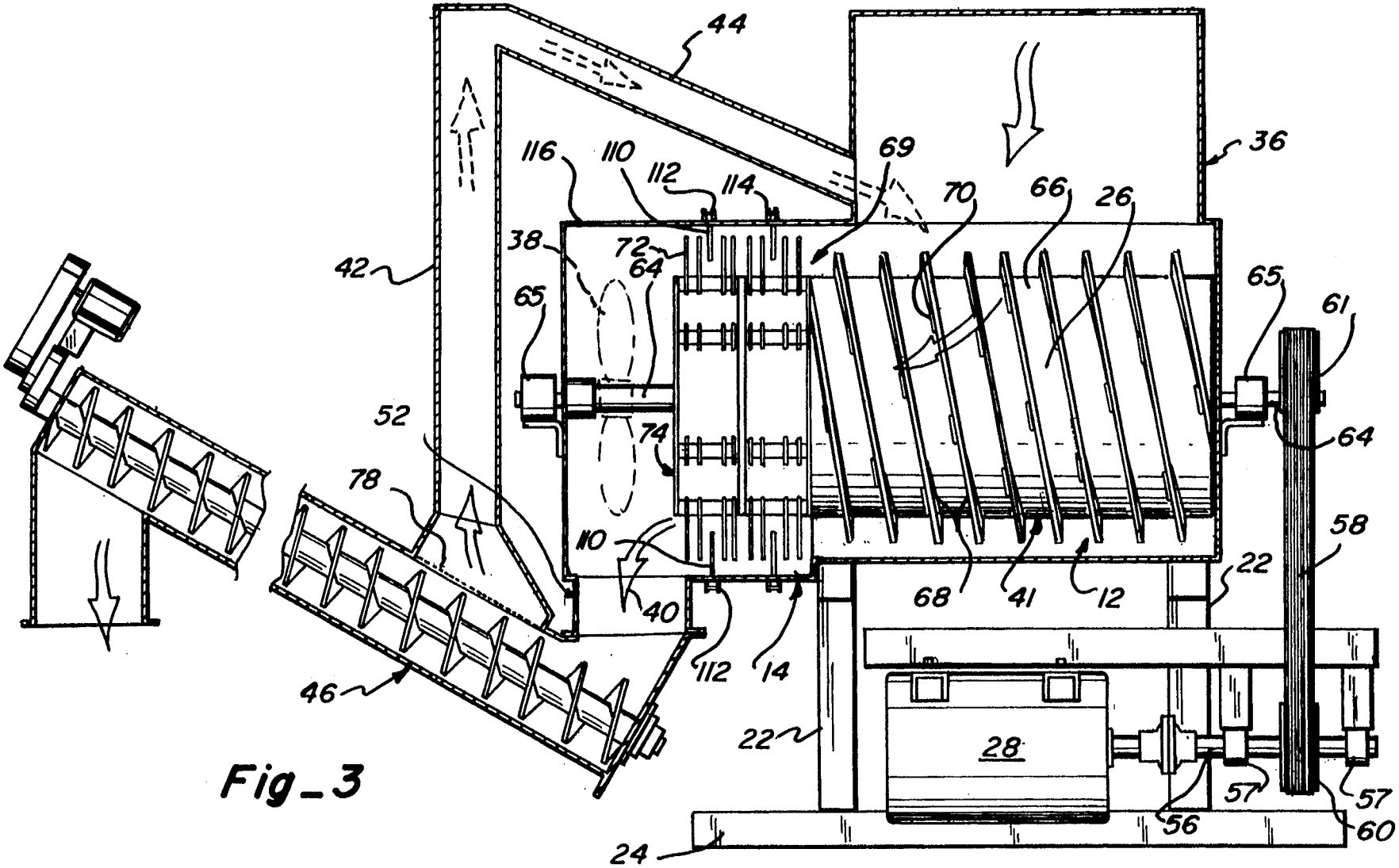
FIG. 3 is a vertical rear view, in partial cross-sectional, of the embodiment shown in FIG. 1, showing a preferred embodiment of a means for removing the comminuted material from the second comminuting chamber means.

FIGS. 1–3 show the remainder of the freshly comminuted material dropping into an output or discharge screw auger 46, which moves the material to a waiting truck or storage location (not shown). Other mechanisms for moving the freshly comminuted particles from the output side of the second chamber means 14 may be used. For example, the screw auger 46 is easily replaced by a conveyor belt 48 that has suitable cleats or ribs 50 spaced the belt 48 (see FIG. 3B). Both the screw auger 46 and the conveyor belt 48 allow the comminuted material to be moved to a higher elevation. Another alternative is to use a tube 52 (see FIG. 3A). A fan 54 located at the output end of the tube 52 is deposed in fluid comminution with the discharge means 53 for the second chamber means 14 and complements the positive air pressure generated by the first stage screw 26 in the first chamber means 12 to move the freshly comminuted particles. A suction at the discharge means 53 is created by the fan 54.

The motor 28 used to power the apparatus 10 rotates a drive shaft 56 (see FIG. 3) which in turn rotates the drive pulley 60 which drives belts 58 which in turn powers the driven pulley 61 mounted on shaft 64. The two pulleys 60, 61 and the belts 58 are not shown in FIGS. 1 and 2 since the drive pulley 60 is covered by a drive pulley housing 62, the driven pulley 61 is covered by a pulley housing (not shown) and the belts 58 are covered by a belt housing 63 (see FIG. 2). These pulley and belt housings 62, 63 protect pulleys 60, 61 and belts 58 from dust and persons operating the apparatus 10 from injury from the rapidly moving parts.

The material to be reduced in size is gravity fed into the top of the first (coarse) comminuting chamber means 12. The chamber means 12 contains a cylindrically shaped drum 66 driven by a comminuter drive shaft 64 which is mounted in bearings 65 shaft. Attached to the first comminuting chamber means drum 66 is the spiral fliting 68 that forms an Archimedes-type screw 26, used to move coarsely comminuted material into the inlet means 69 of the second comminuting chamber means 14. Attached to the spiral fliting 68 are blades 70 (see also FIG. 7) used to perform the first stage (coarse) comminuting. It will be understood that the length of the chamber means can be increased to comminute longer pieces of material.

The spiral fliting 68 on the drum 66 forces the (relatively) coarsely comminuted intermediate sized particles into the second comminuting chamber means 14. Rotation of the drum and its attached fliting 68 assists the flow of comminuted particles through the apparatus 10. In the second chamber means 14, preferably a screenless hammer mill means (i.e., one formed without the screen that encompasses the hammers and through which pieces of material are driven by the hammers), the pieces of the material are further comminuted by hammers 72 (see also FIGS. 4 and 8). The hammers 72 are attached to hammer support structure 74 in the second chamber means 14. The hammer support structure 74 is driven by the shaft 64 which extends through the second comminuting chamber means 14. The hammers 72 cooperate with blades 110 or knives (not shown) attached to the housing 116 of the second comminuting chamber means 14.

The screw 26 in the first chamber means 12 provides the main means for conveying the material to be comminuted through the two chamber means 12, 14 partially as a result of positive air pressure that is created by the rapidly rotating screw 26. The air pressure can be augmented by the addition of a fan 38 mounted for rotation with the drive shaft 64. As shown in FIG. 3, a screen 78 may be installed to intersect small, relatively light weight particles to prevent their return to the first chamber means 12 via chutes 42, 48. Due to the relative weight of the pieces of comminuted material, other than paper or fiber, the amount of material which is returned via chutes 42, 48 (when no screen 78 is used) and recomminuted is usually quite small. The remainder of the pieces of comminuted material is conveyed by the output auger 46 to either a waiting truck (not shown) or stored at a storage site (not shown) for later processing.

The motor 28 drives a shaft 56 supported by bearings 57. The comminuter drive shaft 64 is supported by bearings 65 and drives the drum 66 and hammers 72 in comminuting chamber means 12, 14.

Figure 3A:
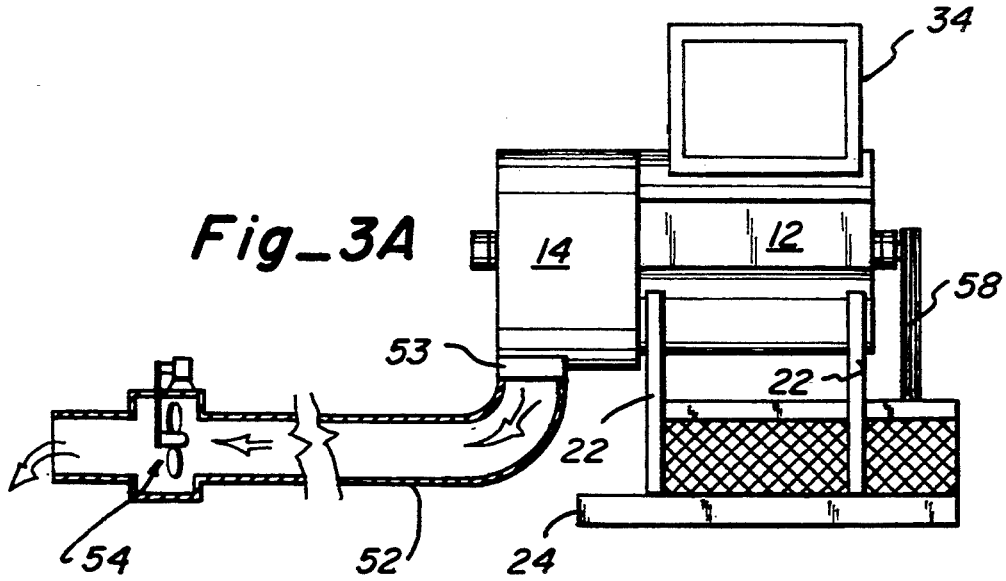
FIG. 3A is vertical rear view, and partial cross-sectional, showing an alternate embodiment for removing the comminuted material from the second comminuting chamber means.

In FIG. 3A, pieces of comminuted particles leaving the second chamber means 14 are pushed by the positive air pressure created by the first chamber means screw 26 which air pressure may be augmented by the fan 54 located adjacent to the discharge tube 52. The fully comminuted pieces of material are conveyed or moved down tube 52 to a truck or storage location (not shown).

Figure 3B:
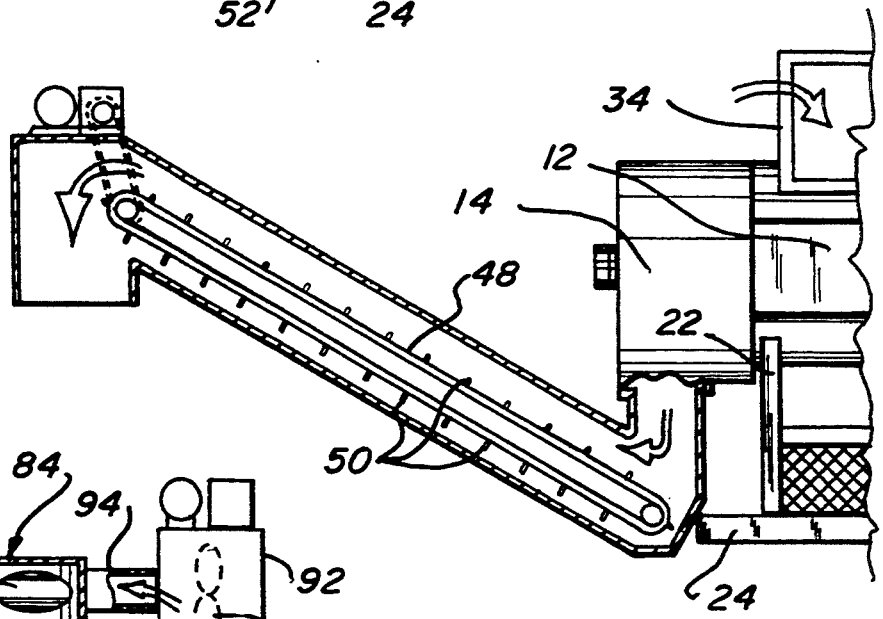
FIG. 3B is vertical rear cross-sectional view of another embodiment of a means for removing the comminuted material from the second comminuting chamber means.

In FIG. 3B, the conveyor belt 48 having ribs or cleats 50 is shown. The ribs or cleats 50 allow the belt 48 to convey the fully comminuted pieces of material or particles from the second chamber means 14 to a higher elevation, where the pieces of material or particles can be discharged into a holding area or a truck (not shown) or made available to another conveyer belt or auger (not shown). Although not shown in FIG. 3B, it will be appreciated that it is also possible to use return ducts or chutes 42, 48 (shown in FIGS. 1–3) to clean up air flowing out of the second comminuting chamber means 14.

Figure 3C:
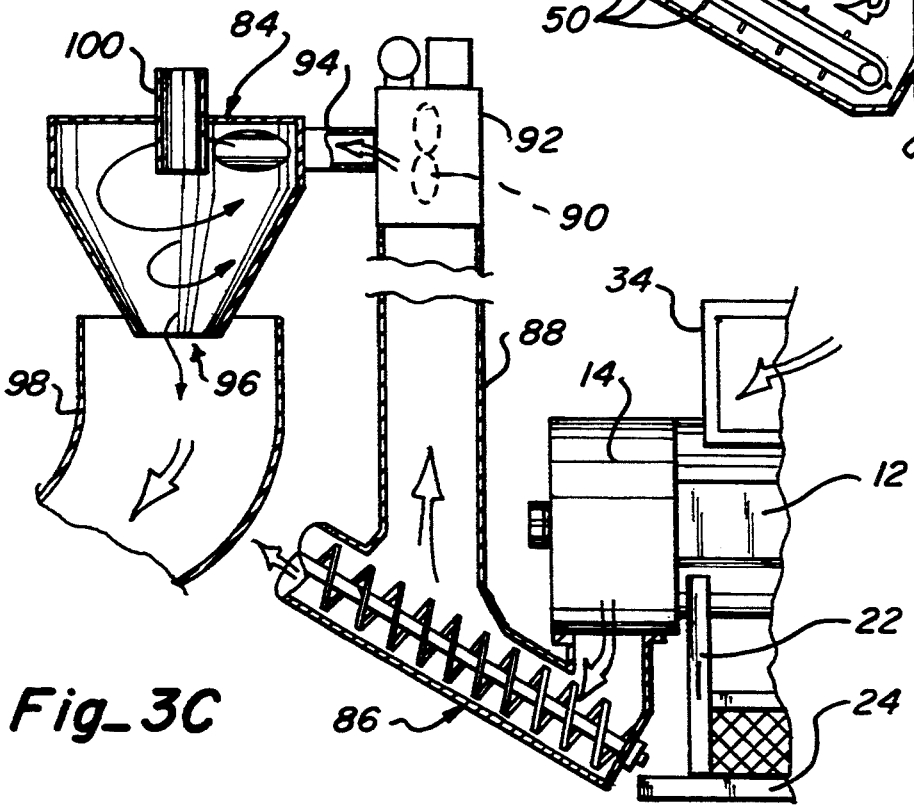
FIG. 3C is vertical rear cross-sectional view of yet another embodiment of a means for removing the comminuted material from the second comminuted chamber means.

In FIG. 3C, a differentiating or classifying cyclone 84 is shown. Fully comminuted pieces of material or particles drop from the second chamber means 14 into an auger 86 (identical or similar to auger 46 shown in FIG. 3). A vertical chute 116 allows the positive air pressure generated by the screw 26 in the first chamber means 12 to pass to auger 86. The positive air pressure causes air and lighter comminuted material to rise through the vertical chute 116. The air pressure from the screw 26 may be augmented by a fan 90 (shown schematically in dotted lines) mounted in a fan housing 92 at the top of the chute 116. The air and lighter pieces of comminuted material then enter the cyclone 84 via duct 94. The cyclone 84 separates the material into two classes. The heavier pieces of material or particles exit through the lower exhaust 96 of the cyclone 84, entering a tube 98 which conveys the heavier pieces of material or particles in one direction. These heavier pieces may be combined with the pieces of material or particles that were conveyed by auger 86. As in the case of conventional cyclones, substantially all of the air flow exits through the upper exhaust 100 of the cyclone 84.

Figure 4:
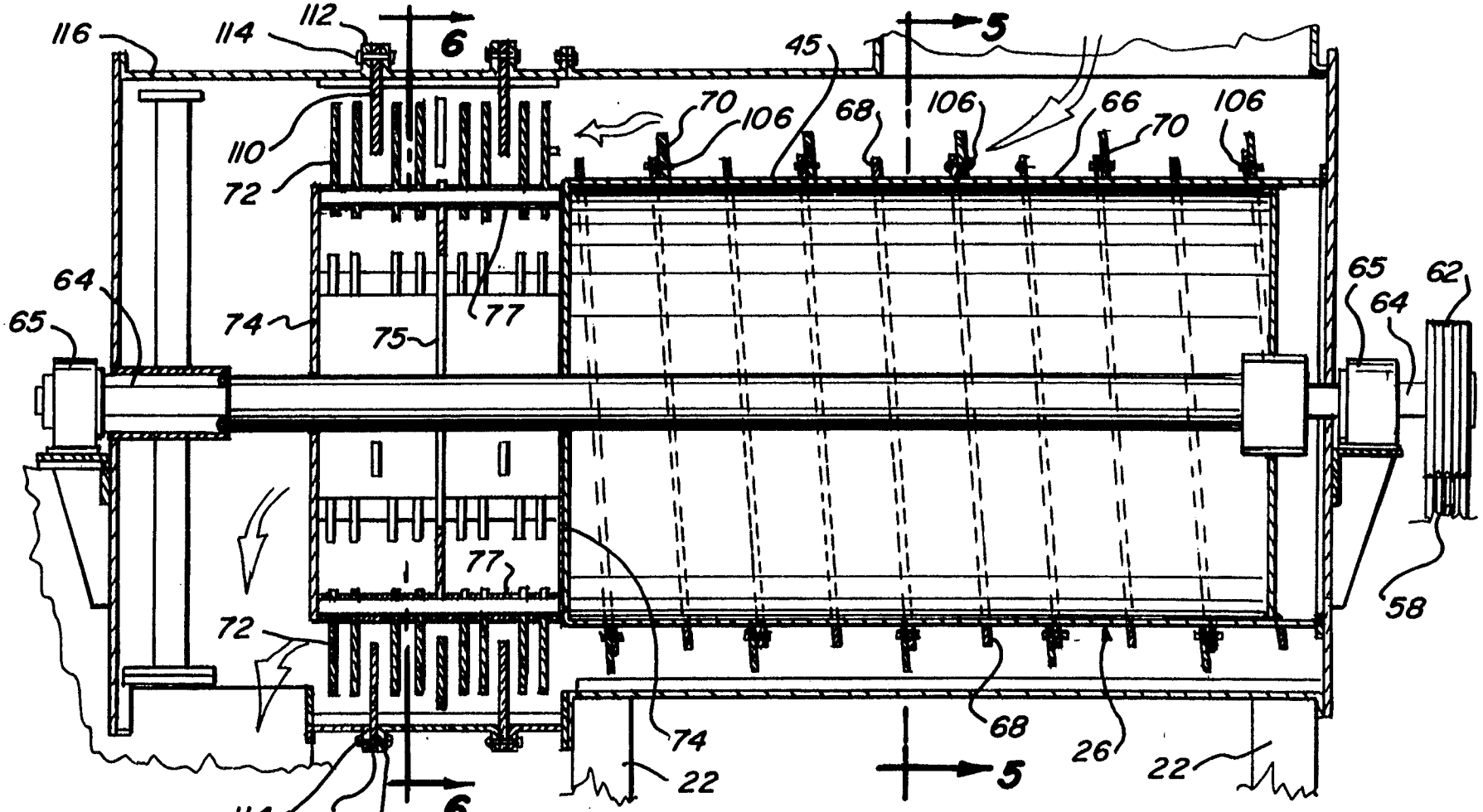
FIG. 4 is a vertical cross-sectional view taken along plane 4—4 of FIG. 2.

FIG. 4 shows the comminuting chamber means drum 66 and the hammer support structure 74 rotatably mounted on the comminuting shaft 64.

It will be understood that the comminuting chamber drum 66 and the hammer support structure 74 may, if desired, be mounted on separate shafts (not shown) with appropriate gearing (not shown) between the two shafts allowing the two shafts (not shown) to rotate at the same or different speeds.

Figure 7:
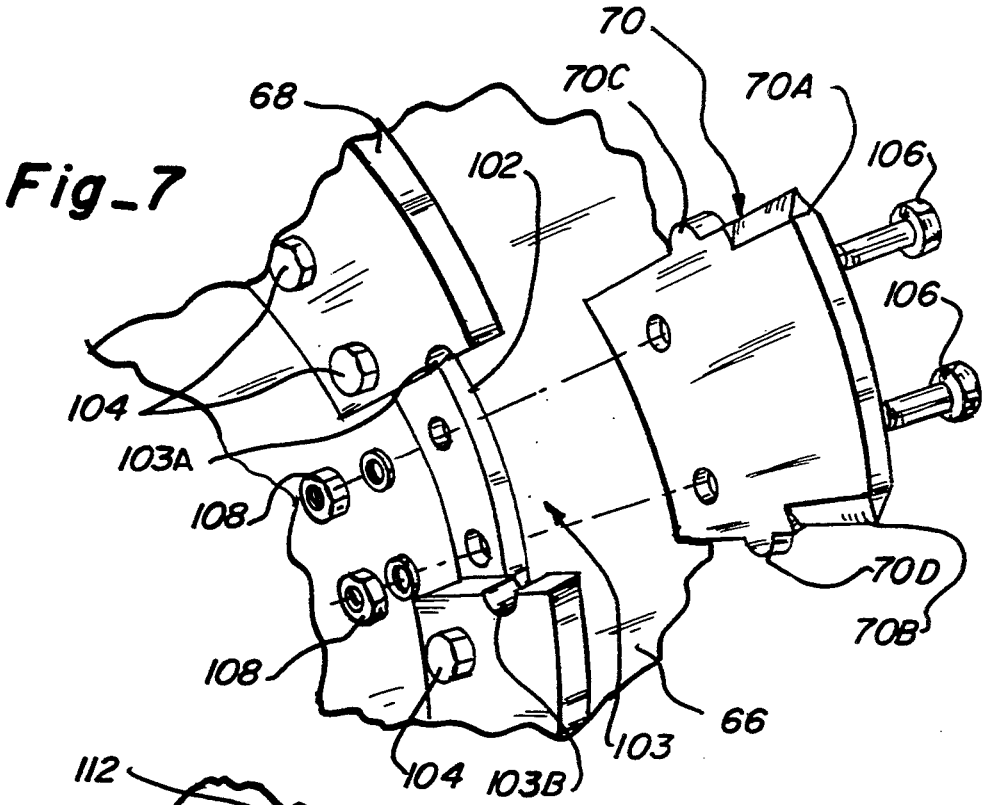
FIG. 7 is an exploded view of a preferred embodiment of a portion of the fliting and one blade used in the first comminuting chamber.

The spiral fliting 68 is preferably mounted onto the drum 66 as shown in FIG. 7. As shown in FIG. 7, a short upstanding spiral rib 102 is securely attached to the outer surface of the drum 66 such as by welding. The spiral fliting 68 is removably mounted to the rib 102 by bolts 104 and nuts (not shown). The fliting 68 has openings 103 to receive the blades 70. Each opposed surface of each opening 103 includes a groove or recess 103A, 103B in which is mounted a mating tongue 70C, 70D formed on the blades 70. By removably mounting fliting 68 to the rib 102, worn fliting 68 may be quickly and easily removed and replaced. This feature greatly prolongs the life of the drum 66 while reducing the cost of maintenance. In turn, the blades 70 are also removably mounted to the spiral rib 102 by bolts 106 and nuts 108 to facilitate quick and easy replacement of the blades 70 when they wear out.

The blades 70 are formed of any suitable material which will resist wear and impact with hard or solid pieces of material. The blades 70 may be formed from an alloy known in the trade as A2 tool steel that is heat treated to 55 Rockwell "C" scale or, preferably, from an abrasive resisting steel manufactured by Ryerson Steel under the brandname Super 500 AR and heat treated to 500 Brinell. The Super 500 AR steel is preferred over the A2 tool steel material because it is less brittle.

The blades 70 are constructed to have two comminuting or cutting surfaces 70A and 70B formed on opposite sides and, thus, the blades can be reversed when one of the surfaces becomes worn. Blades 70 constructed in this manner from these alloys will have an expected operating life of about 200 hours per comminuting surface, i.e., they may be used to comminute trash and the like for about one month per comminuting surface operating at 40 hours per week. It has been found that blades 70 have a much shorter operating life than the fliting 46. The blades 70 aid in performing the first stage (coarse) comminuting. This bolt 106 attachment allows for easy removal and/or replacement of the blades 70.

As shown in FIG. 4, the hammers 72 cooperate with blades 110 or knives (not shown) mounted in brackets 112 on the housing 116 by cotter pins 114. The mounting of the blades 110 from outside the housing 116 allows them to be removed easily from the outside for the periodic replacement necessitated by the cutting action.

FIG. 4 shows the use of a stator member 75 which prevents the cylindrically shaped rod 77 upon which the hammers 72 are mounted from "bowing" outwardly under the influence of centrifugal force. One or more additional stator members (not shown) may be used to prevent material from accumulating between the shaft 64 and the rods 77. This sometimes occurs where rags, plastic and the like are not severed into smaller pieces.

FIG. 5 shows the drum 66 mounted for rotation with the shaft 64. Mounting of the fliting 68 on the drum 66, as previously described, forms an Archimedes-type screw 26. Rapid rotation of the blades 70 cooperate to perform the first stage comminuting. Long pieces of material are held for a period of time by a cutting or holding bar 119 mounted on supports 125A and 125B at the inlet to the lower portion of the housing 120. One or more fine grinding holding bars or means 118A, 118B and 118C may be installed as shown in FIG. 5 in the lower portion of the first comminuting chamber means 12 and extending generally longitudinally along the housing 120 at least approximately one-half the distance and preferably the entire distance. While a long piece of material is being held by the cutting or holding bar 119, the blades 70 rotate and pass the long piece of material thereby reducing the length of a piece of material. The cutting or holding bar 119 functions to provide a cutting surface or base for the blades 70 and cooperate with the blades 70 to perform scissoring or shearing, which effectively comminutes the original long pieces of material. There is approximately 0.1 cm. and 0.2 cm. ($\frac{1}{4}$" and $\frac{1}{2}$") clearance between the blades 70 and the cutting bar 119 and holding bars or means 118A, 118B and 118C. Varying the number of fine grinding means or holding bars 118A, 118B and 118C mounted on the inside of the housing 120 further reduces the size of the particles that exit from the first comminuting chamber means 12 since their use increases the dwell time or the time for the particles to pass through the first comminuting chamber means 12. As shown, the fine grinding means or bars 118A, 118B and 118C, when used, are preferably located intermediate the longitudinal edges of each planar side 122A, 122B and 122C. As shown in FIG. 3, the location of blades 70 on the drum 66 may be staggered both axially and circumferentially about the drum 66 (see FIG. 3).

As shown in FIG. 5, the cutting or holding bar 119 is positioned generally parallel to the center of the shaft 64; its support 125A, 125B and 125C extends generally longitudinally along the inner surface of the housing 121 and is located to intersect and hold longer pieces of material as they enter the lower portion of the first comminuting chamber means 12. It will be understood that cutting bar 119 itself also serves as a fine grinding means; however, the pieces of material are even more finely ground when one or more fine grinding means 118A, 118B, 118C are used.

As shown in FIG. 5, the cross-sectional view of the first comminuting chamber means 12 shows that the housing 120 is preferably formed as a seven-sided polygon 121 with three planar sides 122A, 122B and 122C preferably being located longitudinally extending along the lower portion of the first comminuting chamber means 12. This geometry aids in providing a flow passage means 127 of variable volume between the centers of adjacent sides 122A, 122B and 122C and keeps the material, particularly nonhomogeneous material, from undesirably packing or wedging between the lower planar sides 122A, 122B and 122C of the chamber means 12 and the adjacent surfaces of the screw 26. The volume flow passage means 127 increases at least approximately 33% as the material passes from the middle of side 122A to the middle of side 122B. Where bars 118A, 118B and 118C are used, depending on the size of such bars, the volume of the flow passage means 127 increases at least approximately 250%. Since cutting bar 119 is also a fine grinding means, the volume of the flow passage means 127 increases up to as much as approximately 1800% as the material passes said cutting bar 119 and flows to the middle of side 122B. When fine grinding holding bars 118A, 118B and 118C are used, the width of the flow passage means 127 between the planar sides 122A, 122B and 122C and the fliting 68 is considerably reduced. This results in a finer degree of comminuting than would otherwise be the case.

Figure 5A:
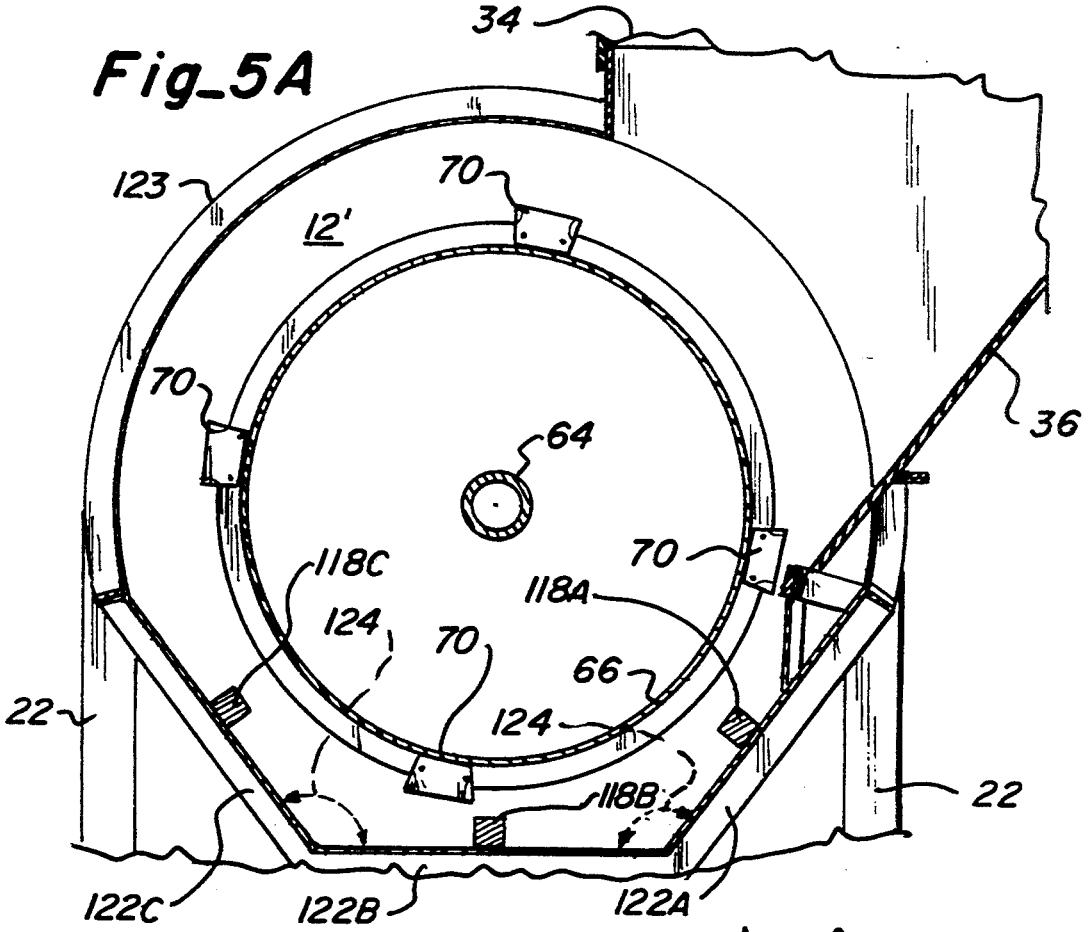
FIG. 5A shows a vertical cross-sectional view of the first comminuting chamber means, with the cutting plan perpendicular to the drive shaft.

FIG. 5A shows an alternative embodiment to the one shown in FIG. 5. In FIG. 5A, the upper portion of the housing 123 for chamber means 12', comprises a longitudinally extending portion of a cylindrically shaped member having a geometric center that is the same as the center of shaft 64. The angle 124 formed between the middle planar side 122B and the planar side on either side thereof varies between approximately 120° and 140° and preferably is about 130°.

Figure 5B:
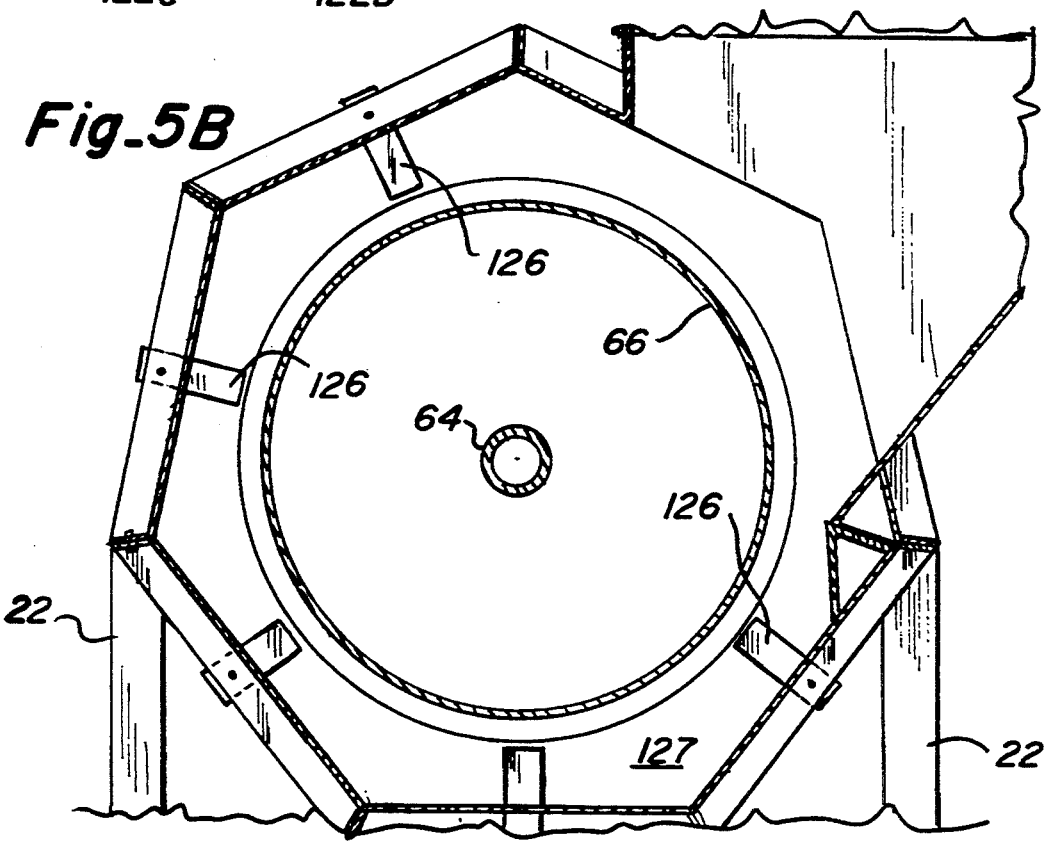
FIG. 5B is another embodiment of the view shown in FIG. 5 showing a vertical cross-sectional view of a portion of the first comminuting chamber means with the cutting plan perpendicular to the drive shaft.

FIG. 5B shows another alternate embodiment to the one shown in FIG. 5. In FIG. 5B, the cutting means 126 are mounted on the housing of chamber means 12 for external removal. This arrangement greatly facilitates the removal and replacement of worn cutting means 126. The cutting means 126 are preferably made from the same material that is used to make the blades 70.

FIG. 6 is a cross-sectional view of the screenless hammer mill means in the second comminuting chamber means 14 and schematically shows a hammer support structure or assembly 74 mounted upon and driven by the shaft 64. Attached to the structure 74 are hammers 72, each of which is preferably mounted on a respective pin or shaft 128. Cooperating with the hammers 72 are blades 110 or knives (not shown) which are attached to the outside of the housing 116 with cotter pins 114 for easy removal from outside the housing 116. A plurality of V-shaped or right angle holding means or bars 117 are radially spaced about the interior of the housing 116 and extend longitudinally along the housing 116 at least approximately one-half the distance and preferably the entire distance of the flow passage means 127. The purpose of these means 117 is to serve as holding bars for holding pieces of material until they are comminuted to a smaller size. These holding bars or means 117 also serve to deflect pieces or particles back toward the hammers 72 for additional comminution. The holding means or bars 117, as shown in FIG. 6, also protect the housing 116 and, thus, prolong the life of the housing 116.

Figure 8:
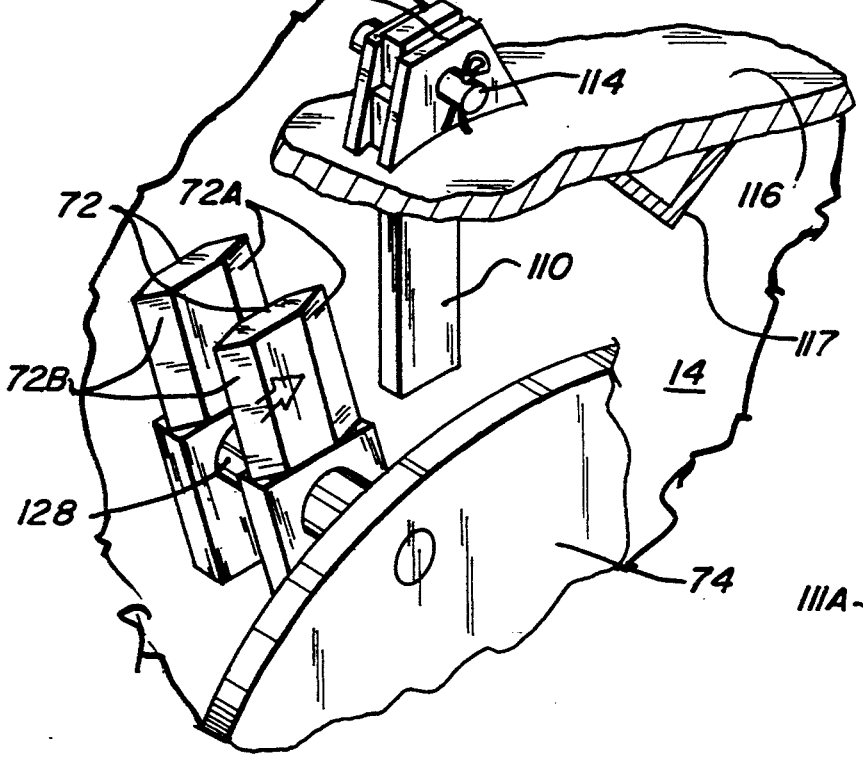
FIG. 8 is a detailed exploded view of a preferred embodiment of hammers and a pair of blades used in the second comminuting chamber means.

FIG. 8 shows a detailed view of a blade 110 and a pair of cooperating hammers 72 in the second comminuting chamber means 14. The hammers 72 are pivotably mounted on hammer pins or shafts 128 which, in turn, are mounted on hammer support structure 74 which, in turn is attached to the cylindrical shaft 64 (shown in FIG. 6). The blades 110 are made from a material similar to the material used to make blades 70. The hammers 72 are made from a material which will provide a long operating life, preferably a high carbon steel known in the trade as C-1080 which is heat treated to 40 Rockwell "C" scale. The hammers 72 have dual impact surfaces 72A, 72B. Each surface, when used to comminute trash or the like, has an operating life of about 200 hours. Thus, by switching from surface 72A to 72B, after surface 72A has become worn, the operating life of the hammers 72 with such dual surfaces may be used for a total of approximately 400 hours.

Figure 8A:
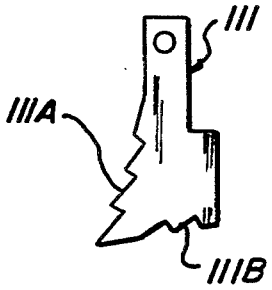
FIG. 8A is a side view of an alternate preferred blade containing serrated edges to facilitate cutting of rags and plastic material.

FIG. 8A is a side view of an alternate preferred blade 111 which is used in lieu of blade 110. Blade 111 is constructed with serrated edges 111A and 111B to intercept and sever rags, plastic and the like thereby preventing same from passing though the second chamber means 14 without being severed into smaller pieces.

The blades 110 or 111 in the second comminuting chamber means 14 cooperate with the hammers 72 to perform a scissoring or shearing operation resulting in the second (final) comminuting operation. The blades 110 are attached to a bracket 112 mounted on the outside of the housing 116 by a cotter pin 114. This allows for rapid replacement of the blades 110 from the outside. This feature is helpful since the blades 110 wear down when comminuting garbage, trash and refuse containing hard materials such as rocks, metal, wood, and sometimes chunks of hard concrete.

The result of the use of the above features is an apparatus 10 that can effectively reduce a wide range of input material to a more consistent, smaller size thereby making it easier to bury or burn. The apparatus 10 can process hard materials such as clumps of earth, rocks, concrete, glass and lumber at the same time as it processes soft materials such as paper and cloth. Likewise, it can process a wide range of sizes of materials at the same time. This makes the invention claimed herein extremely effective in comminuting environmentally bothersome materials such as garbage, refuse, trash and the like.

The blades 70, 72 and 110 and fine grinding holding bars 118A, 118B and 118C in the apparatus 10 are quickly and easily removed and/or replaced.

The foregoing is considered as illustrative only of the principles of the invention. This invention has been described in detail with reference to the particular embodiments thereof, but it will be understood that various other modifications can be effected within the spirit and scope of this invention. For example, improved comminuting results are obtained by using the first or second comminuting chamber means by themselves or in combination with other comminuting chamber means. It will be understood that the invention is not to be limited to the exact construction and operation shown and described and that all suitable modification and equivalents may be used without departure from the scope of the invention.

What is claimed is:

1.An apparatus for reducing material to an approximate specified final size of particles comprising:

a. first and second comminuting chamber means, each of said first and second comminuting chamber means having inlet and discharge means said first comminuting chamber means having a plurality of longitudinally extending planar sides, said first comminuting chamber means having a rotatably mounted drum including a flitting spirally mounted thereon to form a screw which during rotation of said drum moves the material through said first chamber means toward the discharge means of said first comminuting chamber means and into the inlet means of said second comminuting chamber means;

b. a flow passage formed along the planar sides of said first chamber means through which passes the material to be reduced in size said flow passage having a volume that decreases from a predetermined maximum volume to a predetermined minimum volume;

c. said first comminuting means including means for comminuting said material to an approximate specified intermediate size of particles, said first comminuting means and planar sides of said first chamber means forming said flow passage, said first comminuting means including means for feeding said approximate specified intermediate size of particles into said second comminuting chamber means; and d. said second comminuting chamber means including means for comminuting said specified approximate intermediate size of particles to an approximate specified final size of particles.

2. An apparatus as described in claim 1 in which said second comminuting chamber means includes a screenless hammer mill means for comminuting said approximate specified intermediate size particles to said approximate specified final size of particles.

3. An apparatus as described in claim 2 including means for holding in said screenless hammer mill means pieces of material that exceed a predetermined length until said pieces are reduced to a length equal to or less than said predetermined length.

4. An apparatus as described in claim 1 including means for moving said final sized particles away from said second chamber means.

5. An apparatus as described in claim 4 wherein said means for moving said final size of particles away from said second comminuting means includes a screw means located to receive material from the discharge means of said second chamber means.

6. An apparatus as described in claim 4 wherein said means for moving said final size of particles away from said second chamber means includes a fan means having a suction side disposed in fluid communication with said second comminuting chamber means.

7. An apparatus as described in claim 1 including means for holding in the lower portion of said first comminuting chamber means long pieces of material until same are reduced to a length equal to or less than said predetermined length.

8. An apparatus as described in claim 13 wherein:

at least a portion of said reducing means of said first chamber means being removably mounted within said first chamber means.

9. An apparatus as described in claim 8 in which said fliting is mounted on said drum disposed in said first comminuting chamber means.

10. An apparatus as described in claim 9 in which said fliting is removably mounted on said drum.

11. An apparatus as described in claim 9 in which said portion of said reducing means is removably mounted relative to said fliting.

12. An apparatus as described in claim 9 in which said portion of said reducing means is removably mounted on said housing of said first comminuting chamber means.

13. An apparatus as described in claim 1 wherein said first comminuting chamber means includes a housing formed from seven longitudinally extending, generally planar sides which form the inner periphery of said first comminuting chamber means.

14. An apparatus as described in claim 3 wherein said comminuting second chamber means includes a housing and said holding means is mounted on and extends longitudinally along the inner surface of said housing adjacent the inlet to the lower portion of said housing.

15. An apparatus as described in claim 8 wherein at least a portion of said reducing means is, in elevational view, a four sided polygon having cutting edges formed on opposite sides thereof, said cutting edges extending generally radially within said first comminuting chamber means.

16. An apparatus as described in claim 2 in which said screenless hammer mill means includes a plurality of hammers and a support means for said hammers, said support means being rotatably mounted within said second comminuting chamber means.

17. An apparatus for reducing material to an approximately specified size of particles comprising:

a. a comminuting chamber means having a housing formed with a plurality of elongated planar sides and including means mounted within said housing for comminuting said pieces of material; and b. said comminuting means including blade means formed on a rotating drum and holding means formed on the planar sides of said housing to form a flow passage of varying volume through which passes the material during the comminution of said material, said flow passage of varying volume preventing wedging of said material during flow of material therethrough.

18. An apparatus as described in claim 17 in which the lower portion of the inner surface of said housing is formed by three longitudinally extending planar portions, the angle formed between the middle on of said planar portions and the adjacent planar portions varying from 120° to 140°.

19. An apparatus as described in claim 18 including at least one fine grind holding means located in the lower portion of said housing and extending generally longitudinally along the interior of said housing.

20. An apparatus as described in claim 18 in which the angle formed between the middle one of said planar portions and the adjacent planar portions is equal to approximately 130°.

* * * * *